United States Patent [19]

Hirsch

[11] 4,226,487

[45] Oct. 7, 1980

[54] APPARATUS FOR THE DISPLAY AND DISPENSING OF MERCHANDISE

[75] Inventor: Hermann Hirsch, Karnten, Austria

[73] Assignee: Hermann Hirsch Leder- und Kunststoffwarenfabrik, Klagenfurt, Austria

[21] Appl. No.: 896,337

[22] Filed: Apr. 13, 1978

[30] Foreign Application Priority Data

Apr. 15, 1977 [AT] Austria ..... 2674/77

[51] Int. Cl.[2] ..... A47F 1/00

[52] U.S. Cl. ..... 312/42; 312/97.1; 312/119; 221/281

[58] Field of Search ..... 312/42, 59, 60, 61, 312/71, 97.1, 118, 119, 122, 125; 221/281

[56] References Cited

U.S. PATENT DOCUMENTS

| | | | |
|---|---|---|---|
| 1,973,867 | 9/1934 | Cook | 221/281 |
| 2,182,255 | 12/1939 | Ford | 221/281 |
| 2,208,298 | 7/1940 | Mahaffey | 312/97.1 |
| 2,371,845 | 3/1945 | Robison | 221/281 |
| 2,867,487 | 1/1959 | Kirkpatrick | 312/42 |
| 3,172,713 | 3/1965 | Rupert | 312/42 |
| 3,300,090 | 1/1967 | Carden | 221/281 |
| 3,515,265 | 6/1970 | Bartnik | 312/42 |
| 3,650,585 | 3/1972 | Hirsch | 312/71 |
| 3,674,358 | 7/1972 | Sanderson | 312/125 |
| 3,744,866 | 7/1973 | Cook | 312/42 |
| 4,007,853 | 2/1977 | Bahneman | 312/42 |

*Primary Examiner*—Victor N. Sakran

*Attorney, Agent, or Firm*—Young & Thompson

[57] ABSTRACT

Apparatus for the display and dispensing of merchandise with at least one vertically extending carrier supporting the goods. The carrier can be slid out of the apparatus into a position in which it extends most of the way out of the apparatus, this position being determined by a stop, the goods being readily observable in this position. The stop limiting the sliding-out distance of the carrier can be selectively manually displaced from its operative position, whereupon the carrier can be pulled out in its entirety and detached from the apparatus. The goods can be removed from the carrier only after the latter has been detached from the apparatus. Upon re-insertion of the carrier, the stop automatically snaps behind the carrier, so that no special manipulation of the stop is needed at this time.

6 Claims, 5 Drawing Figures

APPARATUS FOR THE DISPLAY AND DISPENSING OF MERCHANDISE

Figure 1:
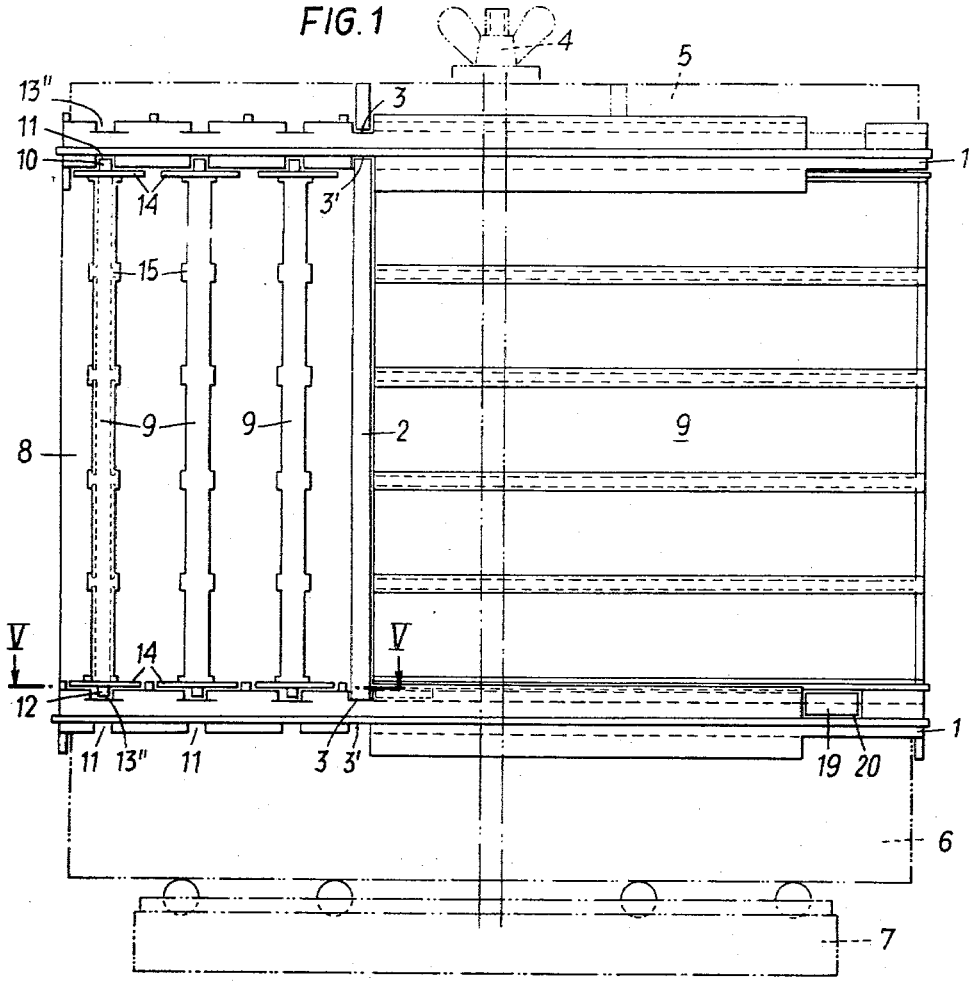

The invention relates to an apparatus for the display and dispensing of goods, such as packaged goods, with at least one carrier for the goods displaceably guided along the apparatus.

Devices for the display and dispensing of goods, such as packaged goods, are conventional, as shown for example in U.S. Pat. No. 3,650,585. The apparatus described in this patent has proven itself very well under practical conditions. However, it has been found that goods are frequently taken from the devices by unauthorized persons and not paid for, especially if these devices are set up in department stores where continuous supervision by sales personnel is impossible.

Therefore, it is an object of the invention to provide an apparatus for the display and dispensing of goods which, although providing a maximally large display area and an unhindered observation of the goods stored and/or displayed therein, yet requires additional manipulation and knowledge for the removal of goods.

According to the invention, this object is achieved by providing that the goods are arranged preferably on both sides of a vertically disposed, essentially plate-shaped carrier and can be removed from the carrier only by displacing them relative to the carrier in a direction opposite to the sliding-out direction of the carrier. The sliding-out distance of the carrier into its position wherein it extends from the apparatus is limited by a selectively-manipulable stop associated with the guide means of the carrier on the apparatus. The stop is connected to a slide, the selective operation of this slide making it possible to displace the stop from its position wherein it limits the sliding-out distance of the carrier into a position wherein it releases the guide means of the carrier, so that the carrier can be detached from the apparatus.

By means of the invention, the carrier can be displaced with the goods to a position wherein it projects from the apparatus and wherein the goods can be looked at without obstruction. However, the goods can be taken out of or removed from the carrier only if the latter has been, in turn, detached from the apparatus, since the goods can be removed from the carrier only by displacement in opposition to its sliding-out direction, and this is only possible when the carrier has been detached from the apparatus. However, this detachment of the carrier is possible only after the stop limiting the sliding out of the carrier has been moved out of the way by manipulating the slide. Thus, the removal of the goods cannot be effected unobtrusively. Nevertheless the authorized removal of the goods is not attended by difficulties, such as, for example, the operation of locked doors or the like.

Additional details of the invention can be seen from the following description of a preferred embodiment.

Figure 3:
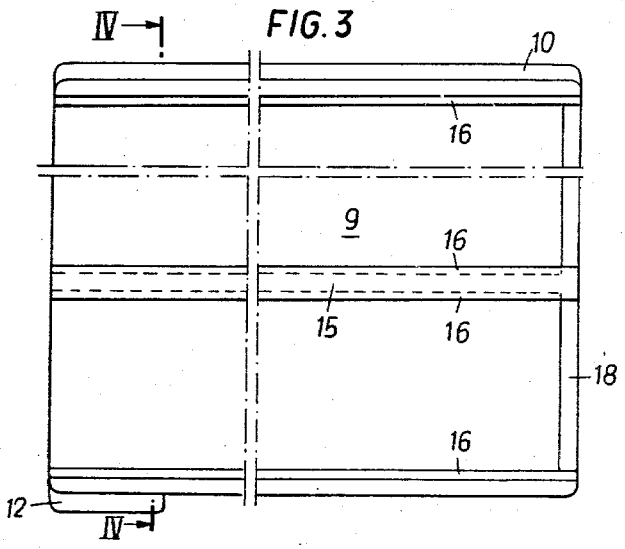
Figure 4:
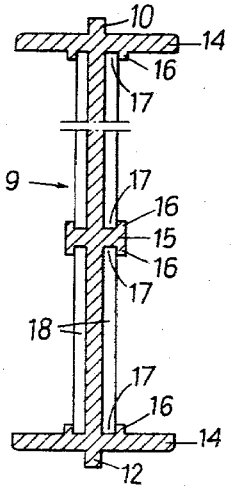
Figure 2:
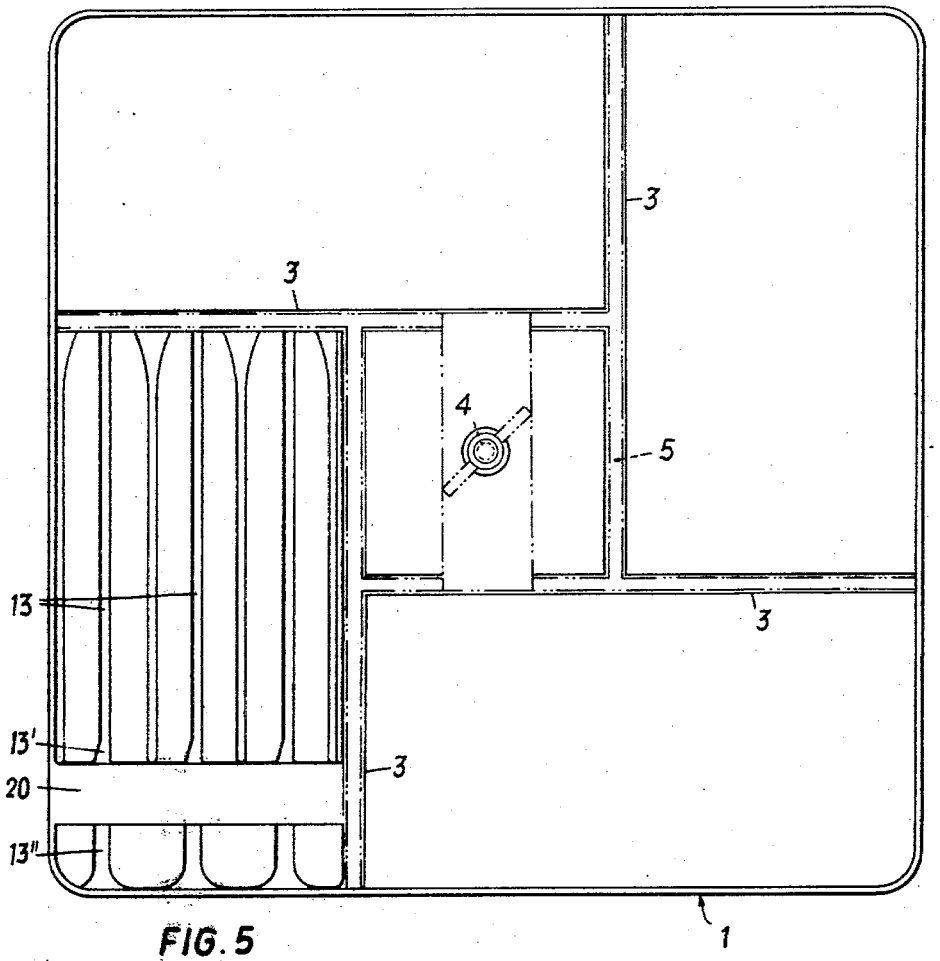
Figure 5:
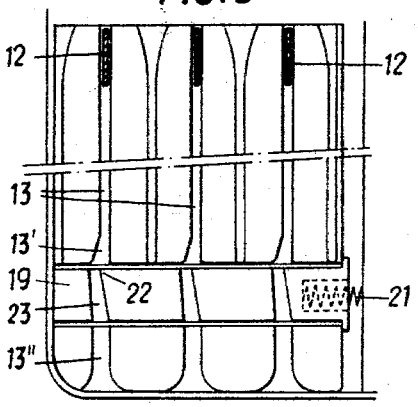

In the drawings:

FIG. 1 is a side elevational view of the essential components of the apparatus of this invention, FIG. 2 is a somewhat schematic top plan view of the uppermost horizontal partition, FIG. 3 shows a carrier in a side elevational view, FIG. 4 is a section, along line IV—IV in FIG. 3, and FIG. 5 is a section along line V—V in FIG. 1.

The apparatus of this invention is modular and comprises, in its simplest structural form shown in FIG. 1, two horizontal partitions 1 spaced apart a mutual distance by four vertical partitions 2 arranged in a stellate pattern. The partitions 2 engage, on the one hand, in grooves 3 on the upper side of the partitions 1 and, on the other hand, grooves 3' on the underside of the partitions 1. The partitions 1 are secured to a base 6 by means of a wing nut 4 and a hold-down spider 5 which latter engages, similarly to the partitions 2, the grooves 3 arranged on the upper side of the upper partition 1. The base 6 is rotatably supported with respect to a base 7 by a ball bearing. In this way, the apparatus can be readily rotated when observing and selecting goods. To enhance the appearance of the apparatus, a hood, not shown in FIG. 1, which covers the wing nut 4 and the spider 5 is placed over the top of the device. It will be readily understood that any desired number of partitions 1 and 2 can be arranged one above the other, so that, depending on the requirements, larger or smaller devices can thus be produced. It is also possible to vary the height of the partitions 2, so that compartments 8 of different height are formed between the individual partitions 1.

FIG. 2 shows the uppermost partition 1, once again in a top plan view, wherein also the spider 5 has been indicated. FIG. 2 shows especially clearly the arrangement of the grooves 3 in which the partitions 2 are optionally inserted.

In the illustrated embodiment, three carriers 9 extending essentially vertically are accommodated in each compartment 8. The carriers 9 are slidably displaceable in the compartments, and for this purpose they engage, with ribs 10 on their upper sides, in grooves 11 on the underside of the upper partition 1. On their undersides, the carriers 9 each have a short rib 12 engaging in one of the grooves 13 on the upper side of the lower partition 1. The grooves 13 can be seen especially clearly in FIG. 2.

To improve guidance, the carriers 9 are additionally provided with flanges 14 at the top and at the bottom, by means of which they are guided on the surfaces of the partitions 1 facing them.

In the illustrated embodiment, the carriers are provided with projecting edge strips for the insertion of packages. For this purpose, the carriers have ribs 15 having a T-shaped profile in cross section, as illustrated especially well in the sectional view of FIG. 4. Furthermore, ribs 16 are arranged on the mutually facing surfaces of the flanges 14 for receiving the packages, which latter have projecting edge strips. The grooves 17 formed by the ribs 15 and 16 are closed by a flange 18 on one vertical edge of the carriers 9. Thus, the packages can be slid out of the grooves 17 only in one direction and then be withdrawn from the carrier. The arrangement is such that the flange 18 is provided on the lateral edge of the carrier 9 opposite to the short rib 12.

The partitions 1 and 2 thus provide a stationary support on and relative to which the carriers 9 are horizontally slidable between extended and retracted positions in which the merchandise on carriers 9 is respectively displayed and stored.

On the upper side of the partition 1 located at the bottom in FIG. 1, a slide 19 is displaceably received in a shallow groove 20 in the partition in the region of each compartment 8. The preferably camouflaged or hidden slide 19 is pressed by a spring 21 toward the outer edge of the partition 1, and in this position stops 22 on the slide 19 block the grooves 13. Consequently, the carriers 9 can be slid out of the compartments 8 only until the short ribs 12 abut the stops 22. By displacing the slide 19, however, the slots 23 between the stops 22 come into alignment with the grooves 13 so that the ends of the grooves 13 are unblocked and the carriers 9 can be pulled completely out of the apparatus, so that the goods stored thereon can be removed.

As can be seen from FIG. 5, the lateral surface of the slot 23 facing the spring 21 is oblique so that it is unnecessary to manually operate the slide 19 upon the reinsertion of a carrier 9, inasmuch as this slide will then be pressed into its release position by the short rib 12. As soon as the short rib 12 has been completely received in the groove 13, it releases the slide 19, and the latter is snapped back by the spring 21 into its locking position shown in FIG. 5. To facilitate the just-described process, the outermost portions 13' of the grooves 13 are wider than the grooves 13 proper. Also the slots 23 widen toward the outside until they assume the width of grooves 13''. In this way, the reinsertion of the carriers 9 is made especially simple.

Normally, the carriers 9 are inserted in the apparatus as illustrated in FIG. 1. Therefore, on the basis of the aforedescribed arrangement, it is possible to pull the carriers only partially out of the compartments 8 so that the goods placed thereon can be visually inspected, while it is impossible to remove the goods from the carriers 9 in this partially extended position. Only after operation of the lever 19 and the complete removal of a carrier 9 is it possible to withdraw a package, which contains watchbands, for example, from the carrier 9 by sliding it out in a direction away from flange 18.

However, the carriers 9 can also be inserted in the compartments 8 in the reversed position, which may be expedient, for example, in case the apparatus can be kept under the constant surveillance of the sales personnel. In this case, the goods placed on the carriers 9 can also be removed without detaching the carriers 9 from the apparatus.

The carriers, in accordance with another embodiment, not shown, can also have channel-type, unilaterally open storage chambers for the goods, which chambers are provided with observation windows, for example, and extend essentially horizontally and are closed at their ends opposite the short rib.

What I claimed is:

1. Apparatus for the display and dispensing of merchandise, comprising a stationary support, at least one vertically disposed merchandise carrier for displaying merchandise and from which merchandise can be selectively removed, means mounting said carrier for horizontal sliding movement on and relative to said support between extended and retracted positions in which the merchandise on said carrier is respectively displayed and stored, slide means mounted on said support for movement relative to said support and normally preventing detachment of said carrier from said support, said slide means being selectively manipulable to permit detachment of said carrier from said support, said slide means including a stop normally positioned in the path of a portion of said carrier to permit partial removal of said carrier from said support but to prevent complete removal of said carrier from said support, said stop moving out of the path of the carrier upon selective manipulation of said slide means to permit complete removal of said carrier from said support, the portion of said carrier that contacts said stop being disposed at one end of the carrier, and means disposed at the other end of the carrier to prevent removal of merchandise from the carrier from said other end of the carrier, whereby merchandise can be removed from the carrier only when the carrier is removed from the support.

2. Apparatus as claimed in claim 1, said portion of the carrier that contacts said stop comprising a member that depends downwardly from said support, said means at the other end of said carrier comprising a vertical flange that closes the outer end of at least one slideway within which merchandise is removably carried by the support.

3. Apparatus as claimed in claim 1, said at least one carrier being in the form of a vertical plate.

4. Apparatus as claimed in claim 3, there being a plurality of said plates disposed in parallelism on said support, said carriers being selectively individually slidable relative to said support, said slide means comprising a series of spaced apart stops each of which is normally positioned in the path of a said carrier, said stops being spaced apart by passageways through which any said carrier may pass upon selective manipulation of said slide means.

5. Apparatus as claimed in claim 4, and spring means urging said slide means toward a position in which said stops are in the paths of said carriers, said slide means being selectively manipulable against the action of said spring means.

6. Apparatus as claimed in claim 5, said passages having obliquely disposed lateral surfaces such that reinsertion of a removed carrier moves said slide means against the action of said spring means to a position to permit reinsertion of the carrier, after which the slide means snaps back under the action of said spring means, into a position to retain the reinserted carrier.

* * * * *